US006159051A

United States Patent [19]

Chang

[11] Patent Number: 6,159,051

[45] Date of Patent: Dec. 12, 2000

[54] LOW PROFILE SMART CARD SYSTEM

[75] Inventor: Yao-Hao Chang, Tu-Chen, Taiwan

[73] Assignee: Hon Hai Precoision Ind. Co., Ltd., Taipei Hsien, Taiwan

[21] Appl. No.: 09/324,608

[22] Filed: Jun. 2, 1999

[30] Foreign Application Priority Data

Jun. 2, 1998 [TW] Taiwan ..... 87208645

[51] Int. Cl.[7] ..... H01R 24/00

[52] U.S. Cl. ..... 439/630; 439/188

[58] Field of Search ..... 439/630, 58, 78, 439/55, 260, 188, 76.1

[56] References Cited

U.S. PATENT DOCUMENTS 5,252,815 10/1993 Pernet ..... 235/441

5,807,124 9/1998 Bricaud et al. ..... 439/188

5,924,861 7/1999 Yasushi et al. ..... 439/188

*Primary Examiner*—Brian Sircus

*Assistant Examiner*—Son V. Nguyen

*Attorney, Agent, or Firm*—Wei Te Chung

[57] ABSTRACT

A low profile smart card system comprises a printed circuit board (PCB) and a smart card connector assembly mounted to the PCB. The connector assembly comprises an L-shaped insulative housing, a number of sickle-shaped contacts and first and second switch terminals retained in the housing by way of insertion molding. Mating portions of the contacts and the switch terminals extend above a mating face of the housing. The housing forms several stands-off in a mounting face thereof. The PCB defines a receiving portion in accordance with shape of the connector assembly such that the connector assembly is swamped in the PCB with the stands-off thereof abutting against a bottom face of the PCB thereby obtaining a low profile above the PCB.

2 Claims, 4 Drawing Sheets

LOW PROFILE SMART CARD SYSTEM

BACKGROUND OF THE INVENTION

The present invention relates to a low profile smart card system, and especially to a combination of a smart card connector assembly and a printed circuit board (PCB), wherein the connector assembly is swamped in the PCB thereby obtaining a low profile above the PCB.

U.S. Pat. No. 5,013,255 and Taiwan Patent Application No. 85205015 disclose smart card connector assemblies of the field of technology that the present invention pertains to. Each prior art connector assembly has a card reader adapted to be soldered on a printed circuit board (PCB). The reader has a number of spring contacts with an arced contact portion and a straight tail portion. A card electrically connects with the connector assembly by having electric pads on the card pressing against and engaging with the arced contact portion of the connector assembly. The thickness of the reader of the thinnest connector of the prior art is 1.2 millimeters, and the thickness of a standard smart card is 2.0 millimeters; thus, the prior art should have a space with a minimum thickness of 3.2 millimeters above the PCB. However, the modern design (for example, a palm computer) may supply a limited space having a thickness of 1.5 millimeters above the PCB. Furthermore, the connector assemblies of the prior art do not provide reliable switches which can effectively determine the situation when the smart card is not correctly inserted into the smart card connector assembly Hence, an improved smart card connector assembly is required to overcome the disadvantages of the prior art.

BRIEF SUMMARY OF THE INVENTION

A main object of the present invention is to provide a low profile smart card system comprising a PCB and a smart card connector assembly mounted to the PCB, wherein the connector assembly is swamped in the PCB thereby obtaining a low profile above the PCB.

Accordingly, a low profile smart card system comprises a PCB and a smart card connector assembly mounted to the PCB. The connector assembly comprises an L-shaped insulative housing, a plurality of sickle-shaped contacts and first and second switch terminals retained in the housing by way of insertion molding. Mating portions of the contacts and the switch terminals extend above a mating face of the housing. The housing forms plural stands-off in a mounting face thereof. The PCB defines a receiving portion in accordance with shape of the connector assembly such that the connector assembly is swamped in the PCB with the stands-off thereof abutting against a bottom face of the PCB thereby obtaining a low profile above the PCB.

Other objects, advantages and novel features of the invention will become more apparent from the following detailed description of the preferred embodiments when taken in conjunction with the accompanying drawings.

DETAILED DESCRIPTION OF THE INVENTION

Figure 1:
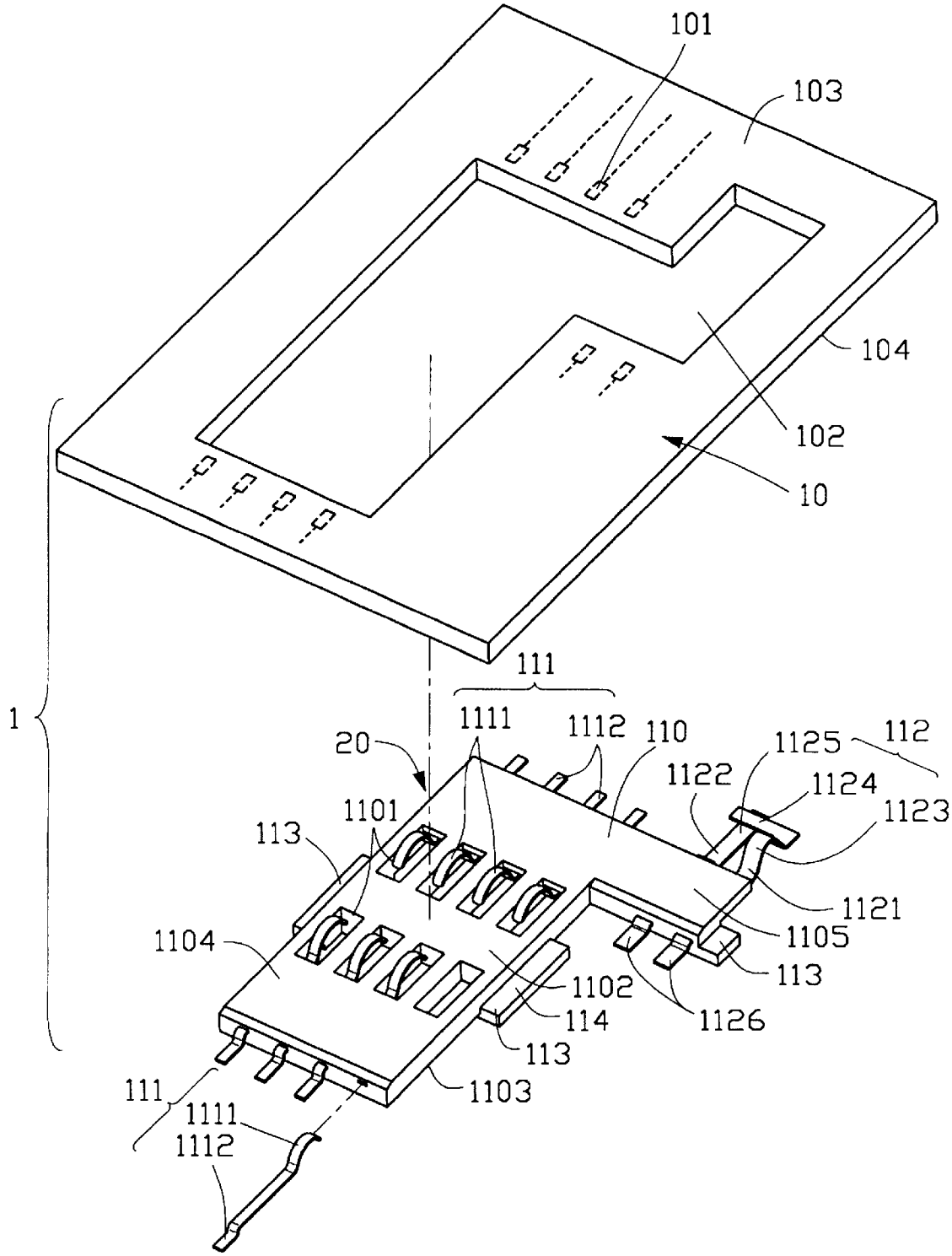
FIG. 1 is an exploded view of a low profile smart card system in accordance with a first embodiment of the present invention.
Figure 2:
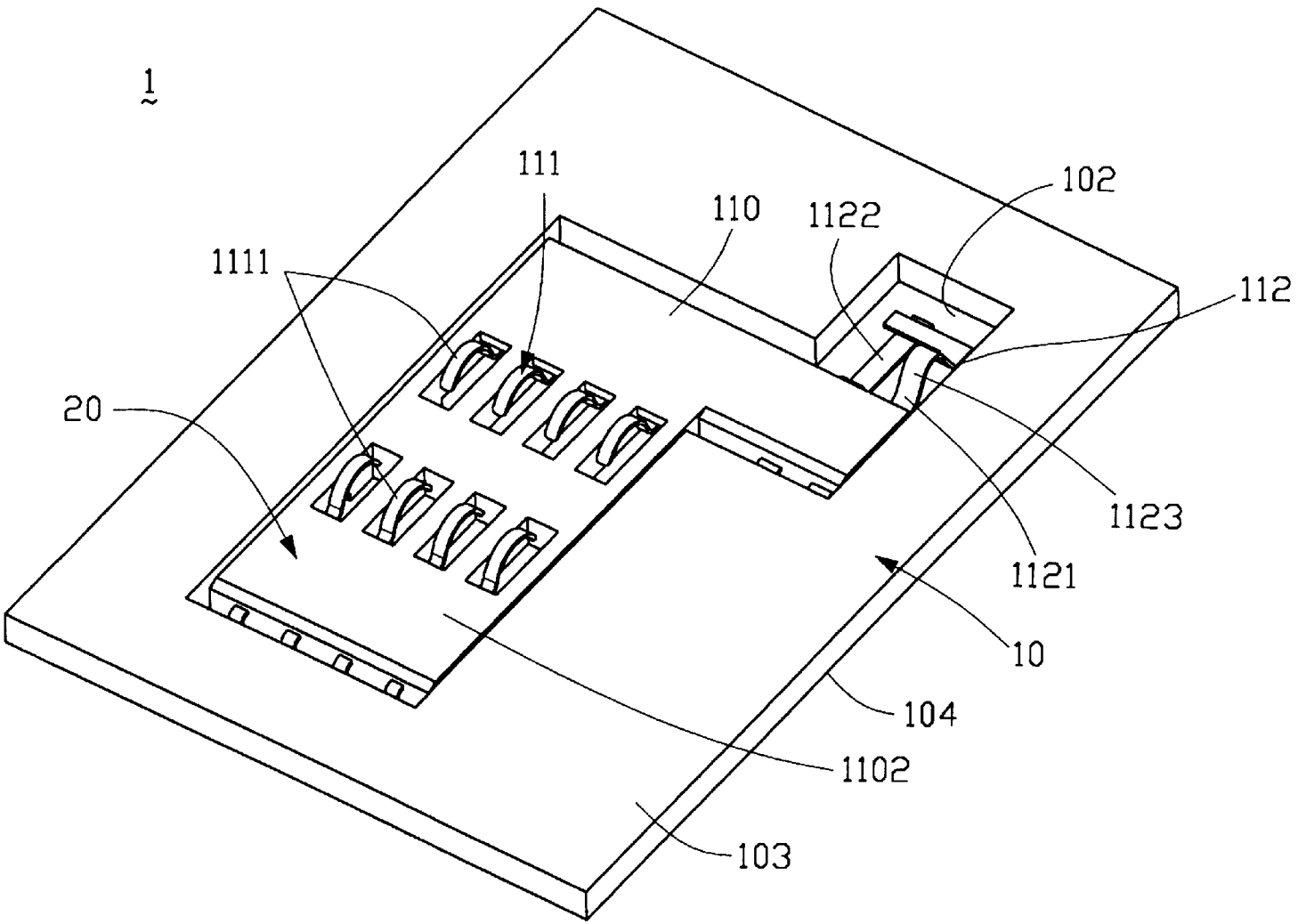
FIG. 2 is an assembled view of FIG. 1.

Referring to FIGS. 1 and 2, a low profile smart card system 1 comprises a printed circuit board (PCB) 10 and a smart card connector assembly 20 mounted to the PCB 10, both of which are commonly received within a casing 500 of a palm computer. The connector assembly 20 comprises an L-shaped insulative housing 110, a plurality of conductive contacts 111 and a switch 112. The housing 110 comprises a rectangular portion 1104 and an extending portion 1105 extending from an end of a lengthwise side of the rectangular portion 1104. The rectangular portion 1104 forms two rows of cavities 1101 defined through a mating face 1102 and a mounting face 1103 of the housing 110. The housing 110 forms plural, generally three, stands-off 113 in the mounting face 1103 thereof, wherein two of them are formed at the opposite lengthwise sides of the rectangular portion 1104 and the other are formed at the extending portion 1105. Each stand-off 113 has a support face 114 being coplanar with each other.

The contacts 111 are stamped from a thin sheet of conductive material to be substantially sickle-shaped. Each contact 111 has an arcuate mating portion 1111 and a mounting portion 1112. The switch 112 comprises a first switch terminal 1122 having a straight connecting portion 1125 and a second switch terminal 1121 having an arcuate connecting portion 1123. A mounting portion 1126 is formed at a free end of the switch terminals 1121, 1122. A blade 1124 extends laterally at a free end of the arcuate connecting portion 1123. The contacts 111 and the switch terminals 1121, 1122 are respectively received in the rectangular portion 1104 and the extending portion 1105 in a lengthwise direction of the rectangular portion 1104 by way of insertion molding. The arcuate mating portions 1111 of the contacts 111 are received in the corresponding cavities 1101 and partially extend beyond the mating face 1102 of the housing 110. The second switch terminal 1121 is retained in the extending portion 1105 of the housing 110 with the connecting portion 1123 partially extending beyond the mating face 1102 of the housing 110. In addition, soldering faces of the mounting portions 1112, 1126 of all the contacts 111 and the switch terminals 1121, 1122 are coplanar with the support faces 114 of the stands-off 113.

The PCB 10 has a top face 103 and a bottom face 104. The bottom face 104 provides a plurality of conductive circuit pads 101 for being electrically contacted with the mounting portions 1112, 1126 of the contacts 111 and the switch terminals 1121, 1122. The PCB 10 defines a receiving portion comprising a cavity 102 in accordance with shape of the connector assembly 20 through the top and bottom faces 103, 104 thereof for receiving the connector assembly 20 thereby reducing profile of the connector assembly 20 above the PCB 10.

Figure 3:
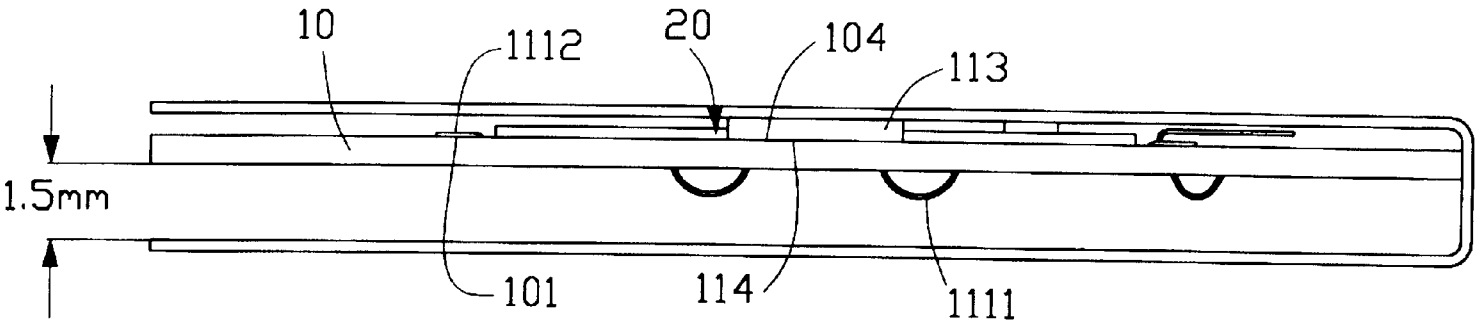
FIG. 3 is a side, planar view of the smart card system received in a shell of a computer.
Figure 4:
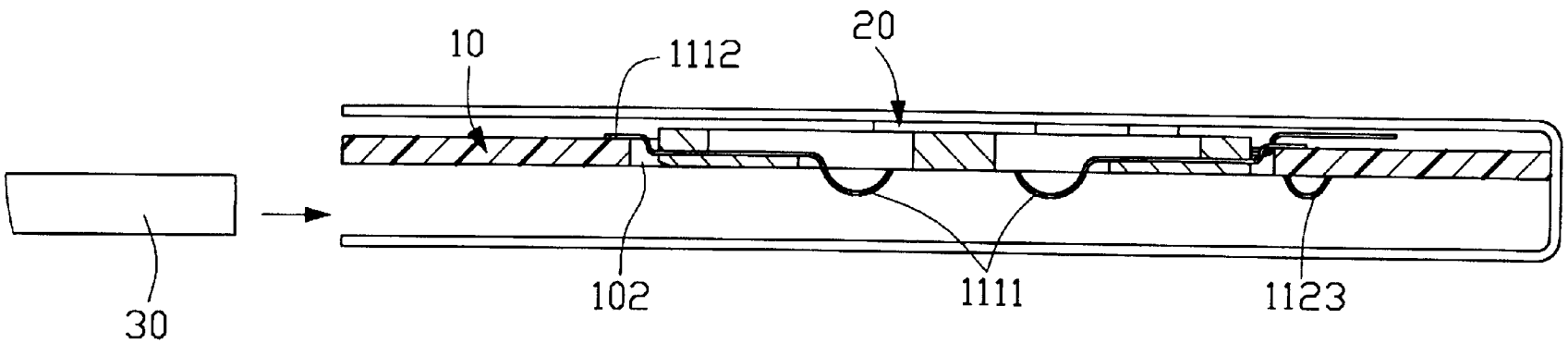
FIG. 4 is a cross-sectional view of FIG. 3.

Also referring to FIGS. 2, 3 and 4, the connector assembly 20 is received in the cavity 102 of the PCB 10 with the support surfaces 114 of the stands-off 113 (FIG. 1) abutting against the bottom face 104 of the PCB 10. The mounting portions 1112, 1126 of the contacts 111 and the switch terminals 1121, 1122 also abut against the corresponding circuit pads 101 of the PCB 10 because the soldering faces of the mounting portions 1112, 1126 are coplanar with the support faces 114 of the stands-off 113 that is described above. Then the mounting portions 1112, 1126 are soldered to the circuit pads 101 of the PCB 10 and the connector assembly 20 is retained in the PCB 10. The blade 1124 of the second switch terminal 1121 and the connecting portion

1125 of the first switch terminal 1122 are switchable between a first connected/separated position and a second separated/connected position in response to insertion of a memory card 30 (FIG. 4) into the memory card connector assembly 1.

Figure 5:
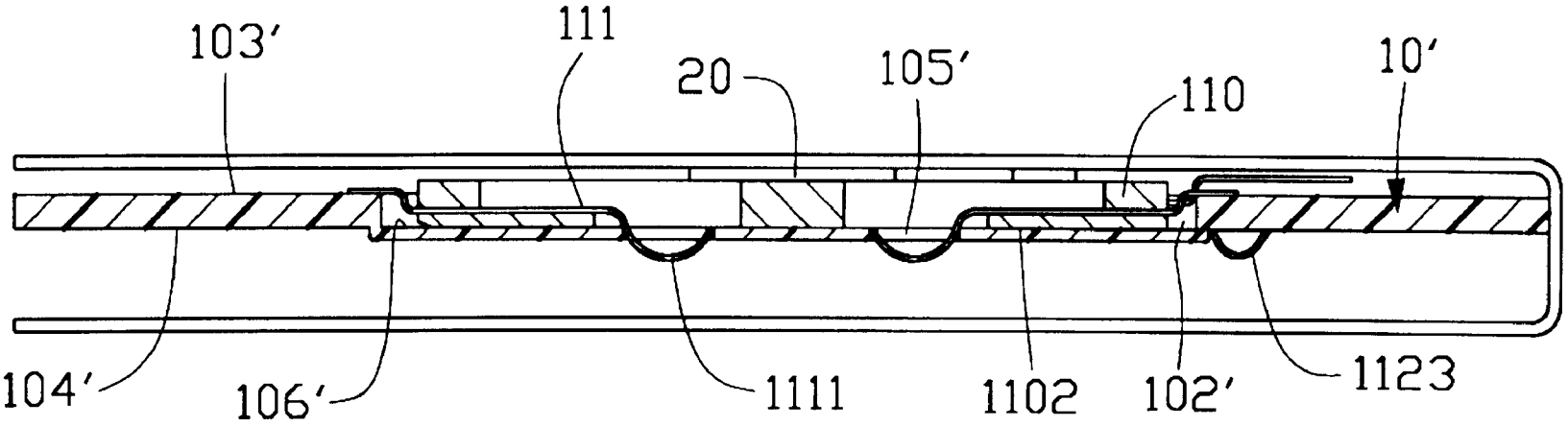
FIG. 5 is a view similar to FIG. 4 illustrating a second embodiment of the low profile smart card system.

Referring to FIG. 5, a second embodiment of the low profile smart card system is similar to the first embodiment except that the cavity 102 of the PCB 10 of the first embodiment is replaced by a recess portion 102' which has a bottom 106'. The bottom 106' defines a plurality of cutouts 105' in register with the mating portions 1111 of the contacts 111 of the connector assembly 20. The connector assembly 20' is received in the recess portion 102' with the mating face 1102 of the housing 110 abutting against the bottom 106' of the recess portion 102'.

The feature of the invention is to provide an arrangement of a printed circuit board 10 and the corresponding connector assembly 20 thereon, both of which are commonly received within a tiny space of a casing 500 of the computer wherein such a tiny space is defined by two closely spaced opposite planes 501, 502 of the casing 500, and the printed circuit board is positioned closer to one plane 501 and spaced from the other plane 502 with a distance proximate 1.5 mm. This feature may be implemented by provision of the cavity 102 within the printed circuit board 10, which is large enough to receive most portions of the housing 110 of the connector assembly 20 to compensate the thickness of the housing 110. Additionally, the housing 110 is mounted to the printed circuit board 20 from the bottom side of the printed circuit board 10, i.e., the side of the printed circuit board 10 closer to the plane 501, and the horizontal mounting portions 1112 of the contacts 111 are soldered on the bottom face 104 of the printed circuit board 10. The above arrangements may facilitate miniaturization of the whole system.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical interconnection system comprising:

a printed circuit board having a first surface and an opposite second surface, the first surface forming a plurality of circuit pads, the board further comprising a recess portion recessing a predetermined distance from the first surface thereof toward the second surface thereof, and a bottom in the recess portion; and a connector assembly comprising a housing, a plurality of contacts and a first and a second switch terminals retained in the housing with mating portions of the contacts and connecting portions of the switch terminals partially extending above a mating face of the housing, the housing forming a plurality of stands-off in a mounting face thereof, the mounting face being opposite the mating face;

wherein the connector assembly is received in the recess portion of the board with the stands-off of the housing abutting against the first surface of the board and the bottom in the recess portion of the board abutting against the mating face of the housing thereby obtaining a low profile above the board, and a connecting portion of a selected one of the first and the second switch terminals is movable relative to an other connecting portion of the other of the first and the second switch terminals in response to insertion of a card into the electrical interconnection system;

wherein each of the stands-off has a support face coplanar with solder faces of the contacts and the switch terminals soldered onto the circuit pads of the board; and wherein the bottom defines a corresponding number of cutouts in register with the mating portions of the contacts.

2. The electrical interconnection system as claimed in claim 1, wherein the housing comprises a rectangular portion and an extending portion laterally extending from an end of a lengthwise side of the rectangular portion so that the housing has generally an L shape, the contacts and switch terminals being respectively retained in the rectangular portion and the extending portion.

* * * * *